US012553430B2

(12) United States Patent
Hahmann et al.

(10) Patent No.: US 12,553,430 B2
(45) Date of Patent: Feb. 17, 2026

(54) CONVEYING DEVICE

(71) Applicant: Hydac Technology GmbH, Sulzbach / Saar (DE)

(72) Inventors: Wolfgang Hahmann, Kempen (DE); Frank Bauer, Marpingen (DE); Peter Kloft, Ransbach-Baumbach (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 0 days.

(21) Appl. No.: 18/556,815

(22) PCT Filed: Apr. 13, 2022

(86) PCT No.: PCT/EP2022/059908

§ 371 (c)(1),
(2) Date: Oct. 23, 2023

(87) PCT Pub. No.: WO2022/223404

PCT Pub. Date: Oct. 27, 2022

(65) Prior Publication Data

US 2024/0200542 A1 Jun. 20, 2024

(30) Foreign Application Priority Data

Apr. 24, 2021 (DE) ..... 10 2021 002 178.9

(51) Int. Cl.
*F04B 45/033* (2006.01)
*F04B 45/02* (2006.01)
*F04B 53/08* (2006.01)

(52) U.S. Cl.
CPC ..... *F04B 45/0336* (2013.01); *F04B 45/022* (2013.01); *F04B 53/08* (2013.01)

(58) Field of Classification Search
CPC .... F04B 43/009; F04B 43/067; F04B 43/107; F04B 39/04–048; F04B 45/0333;
(Continued)

(56) References Cited

U.S. PATENT DOCUMENTS 2,272,721 A * 2/1942 Mccoy ..... C02F 1/686 137/101.25
3,539,277 A * 11/1970 Andrews ..... F04B 39/0022 417/473

(Continued)

FOREIGN PATENT DOCUMENTS

DE 10 2014 217 897 3/2016 ..... F04B 45/033
DE 102014217897 A1 * 3/2016 ..... F04B 37/12

(Continued)

OTHER PUBLICATIONS

Search Report for International Application No. PCT/EP2022/059908, 5 pages.

(Continued)

*Primary Examiner* — Thomas Fink
(74) *Attorney, Agent, or Firm* — Slayden Grubert Beard PLLC

(57) ABSTRACT

Disclosed is a conveying device for fluids with an inlet and an outlet and a conveying part which is connected therebetween and can be actuated by a drive part, wherein the conveying part has a fluid-tight media-separating device with a variable chamber volume, which becomes connected in a fluid-conducting manner via its receiving chamber to the inlet or the outlet, and which, by means of the drive part, receives fluid via the inlet as part of an intake stroke, increasing the chamber volume, and discharges the received fluid via the outlet as part of a discharge stroke, reducing the size of said chamber volume.

21 Claims, 5 Drawing Sheets

(58) Field of Classification Search
CPC .. F04B 45/0733; F04B 45/022; F04B 9/1095; F04B 9/1172; F04B 9/1174; F04B 9/10; F04B 9/109; F04B 9/117; F04B 53/08
See application file for complete search history.

(56) References Cited

U.S. PATENT DOCUMENTS

| | | | | |
|---|---|---|---|---|
| 4,518,317 | A * | 5/1985 | Inoue | F04B 43/00 417/419 |
| 4,990,058 | A * | 2/1991 | Eslinger | F04B 9/113 417/18 |
| 2009/0324431 | A1* | 12/2009 | van Boeyen | F04B 45/02 417/375 |
| 2014/0318115 | A1 | 10/2014 | Schulz | 60/414 |
| 2015/0190751 | A1* | 7/2015 | Naito | B01D 53/79 422/105 |
| 2016/0123313 | A1* | 5/2016 | Simmons | F04B 9/133 417/392 |
| 2017/0175729 | A1 | 6/2017 | Hoehne | F04B 45/02 |
| 2018/0135606 | A1* | 5/2018 | Oklejas, Jr. | F04F 13/00 |
| 2019/0282926 | A1 | 9/2019 | Stricko | B01D 15/40 |
| 2020/0132058 | A1* | 4/2020 | Mollatt | F04B 45/033 |

FOREIGN PATENT DOCUMENTS

| | | | | |
|---|---|---|---|---|
| JP | H01217234 | A * | 8/1989 | |
| JP | 2005010078 | A * | 1/2005 | G01L 19/0023 |
| KR | 100459461 | B1 * | 12/2004 | F04B 35/04 |
| RU | 2685353 | C1 * | 4/2019 | F04B 43/0054 |
| WO | 2013 079222 | | 6/2013 | F15B 21/14 |
| WO | 2019 007768 | | 1/2019 | F04B 15/02 |

OTHER PUBLICATIONS

International Preliminary Report on Patentability, Application No. PCT/EP2022/059908, 6 pages.

* cited by examiner

CONVEYING DEVICE

CROSS-REFERENCE TO RELATED APPLICATIONS

This application claims priority to German Patent Application No. DE 10 2021 002 178.9, filed on Apr. 24, 2021 with the German Patent and Trademark Office. The contents of the aforesaid Patent Application are incorporated herein for all purposes.

TECHNICAL FIELD

The invention relates to a conveying device for fluids with an inlet and an outlet and a conveying part which is connected therebetween and can be actuated by a drive part.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

WO 2013/079222 A2 discloses a conveying device for improving the energy efficiency in hydraulic systems, having an actuator which in one operating state operates as a consumer of hydraulic energy and in another operating state operates as a producer of hydraulic energy, and having a hydraulic accumulator which in the one operating state of the actuator can be charged by said actuator for energy storage and in the other operating state can be discharged for delivering energy to the actuator. A discontinuous, adjustable hydropneumatic piston accumulator, in which a plurality of pressure chambers are formed that are adjacent to differently sized effective areas on the fluid side of the accumulator piston, serves as the hydraulic accumulator. In addition, an actuating arrangement is provided which, depending on the respective pressure levels prevailing on the gas side of the piston accumulator and at the actuator, connects a selected pressure chamber or a plurality of selected pressure chambers of the piston accumulator to the actuator.

This results in the possibility of recycling energy independently of the precharge pressure on the gas side of the accumulator and independently of the respective load pressure because, by selecting an effective area of suitable size, the respective desired pressure level at the accumulator can be used for charging or discharging. This enables optimum energy conversion in all operating states. The known multi-piston arrangement for the piston accumulator requires seals, such as metallic piston rings or rubbery-elastic plastic seals, to seal the individual piston chambers against each other. Due to the high forces and pressures which occur during operation, it is usually also necessary to additionally use lubricants to keep the friction forces as low as possible so as thus to reduce wear and create a seal that is as leak-free as possible. Nevertheless, leaks cannot be avoided and friction causes wear on both the individual pistons and the associated sealing material. Although these wear particles are usually small, they nevertheless lead to contamination of the gases or liquids to be conveyed, some of which can also be of high purity, which can then in turn only be remedied by very elaborate filtering measures in the fluid flow.

SUMMARY

Based upon this prior art, a need exists to provide a conveying device with which it is possible to prevent contamination from entering the fluid to be conveyed or compressed. The need is addressed by the subject matter of the independent claim(s).

Embodiments of the invention are described in the dependent claims, the following description, and the drawings.

DESCRIPTION

Figure 1:
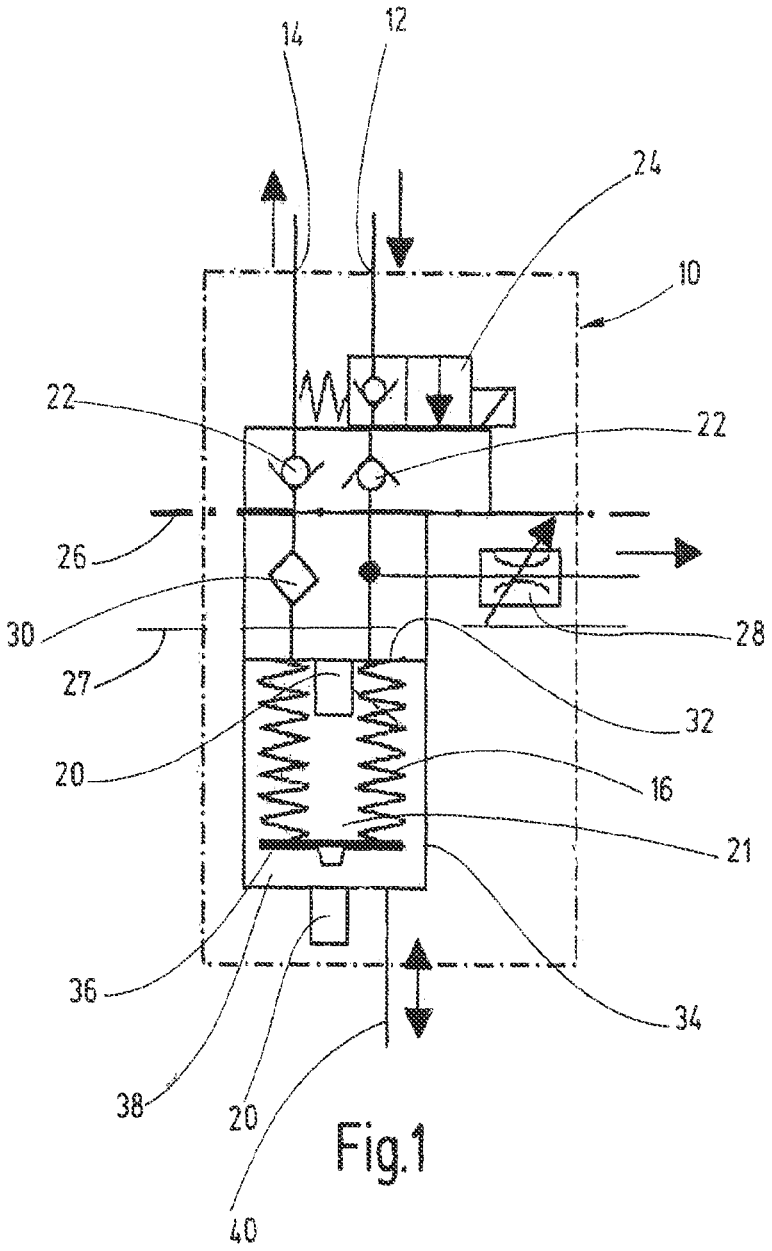
FIG. 1 shows components of a conveying part of an example conveying device.

The details of one or more embodiments are set forth in the accompanying drawings and the description below. Other features will be apparent from the description, drawings, and from the claims.

In the following description of embodiments of the invention, specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In some embodiments, the conveying part has a fluid-tight media-separating device with a variable chamber volume, which becomes connected in a fluid-conducting manner via its receiving chamber to the inlet or the outlet, and which, by means of the drive part, receives fluid via the inlet as part of an intake stroke, increasing the chamber volume, and discharges the received fluid via the outlet as part of a discharge stroke, reducing the size of said chamber volume thus ensuring that no leaks occur in the conveying part and also that no contamination enters the fluid to be conveyed or compressed. The fluid-tight media-separating device ensures that no medium from the drive side can reach the conveying side for the fluid and in this respect also prevents any contamination from entering on the transport fluid side. The conveying device can transport incompressible fluids, such as any type of liquids; but also compressible media, for example in the form of high-purity gases, such as hydrogen, which are compressed in the process. It is also possible to convey or compress fluids composed of compressible and incompressible fractions. In this respect, undesirable entry of a working gas on the liquid side is similarly prevented.

In some embodiments of the conveying, it is provided that the media-separating device is formed of a bellows which is fluidically controlled from the outside by means of the drive part in such a manner that the inner chamber volume of the bellows increases during an intake stroke and decreases during a discharge stroke. In practice, the bellows used as a media-separating device, usually in the form of conventional bellows, is regarded as absolutely media-tight, i.e., no medium can pass through the bellows wall either from inside to outside or vice versa, and with an appropriate configuration in stainless steel, the media-separating device is also to be regarded as resistant to embrittlement in hydrogen applications. Due to the pleated configuration of the bellows, it has only a relatively small storage and discharge volume in volumetric terms compared with other hydraulic accumulators, such as bladder accumulators for example; compared with the elastomeric accumulator bladder alone, conveying operation can be achieved with high cycle times, during which the individual bellows pleats go into full contact with each other in the contracted state of the bellows, which stabilises the bellows arrangement as a whole and helps to prevent malfunctions.

In some embodiments of the conveying device, it is provided that the drive part has a hydraulic working cylinder which can be controlled by means of a hydraulic drive and a main valve. In this way, actuation of the conveying part, which can also act as a compressor part, can be controlled using conventional hydraulic components for the drive part. The said components of the drive part can be standardised and thus easily adapted to the desired conveying and compression output for the conveying part or compressor part.

In some embodiments of the conveying device, it is provided that the hydraulic working cylinder with its piston-rod unit uses a metering chamber of predefinable metering volume to predefine the intake and discharge stroke for the conveying part, for example on the piston side and that for example the working cylinder is actuated via the main valve on the rod side. The metering volume referred to is almost incompressible with the result that a movement of the hydraulic working cylinder as a so-called pump cylinder can be transferred to the media-separating device without loss or delay. Particularly for smaller volume flows and lower pressures, the function can also be swapped from piston side to rod side. In this way, it is possible to transmit pressure in both directions.

In some embodiments of the conveying device, it is provided that, in order to obtain a homogenised conveying volume flow, a further conveying part is provided which performs a discharge stroke, while the other conveying part performs an intake stroke and vice versa. In this way, the conveying device can be operated virtually continuously, with one conveying part always ensuring the discharge of fluid under pressure, while the further conveying part is loaded with fluid in the intake stroke for the subsequent discharge stroke.

In this case, it is beneficial that the further conveying part is likewise connected to the working cylinder which has a second piston that is connected to the piston rod by way of the first piston for the one metering chamber, thus forming a further metering chamber of predefinable metering volume. In this way, the conveying device can be operated with two conveying parts in synchronous sequence with only one working cylinder or pump cylinder.

In some embodiments of the conveying device, it is provided that for conveying gases the respective conveying part acts as a compressor part, that two compressor parts form a single-stage compressor and that the interconnection of a plurality of single-stage compressors results in a multi-stage compressor. In this way, a low pressure existing on the gas inlet side can then be brought to a higher medium pressure in comparison by means of the first compressor stage which medium pressure is converted in turn into high pressure by means of the second compressor stage on the gas outlet side.

In some embodiments of the conveying device, it is provided that, particularly to compensate for leaks at the working cylinder, at least one metering unit is present which h introduces small quantities of metering volume into the respective metering chamber or discharges them therefrom.

The metering unit can be used for example to add small volumes to the metering volume of the working or pump cylinder or if necessary to withdraw them from this metering volume. For this purpose, the respective metering unit is for example connected to a metered adding or withdrawal unit by means of metering valves and the respective metering unit can be protected by a secondary pressure protection device. The metering valves can be used to perform very precise metering processes and the secondary pressure protection device mentioned, which may for example consist of a pressure relief valve, serves to protect against overloads.

Furthermore, it may for example be provided that the positions of the working cylinder can be detected via an end position monitor. In this way, it is possible to monitor the function for the working or pump cylinder, in which case a different form of a cylinder monitor can be used instead of an end position monitoring.

In some embodiments of the conveying device, it is provided that homogenisation of the conveying flow takes place by means of hydraulic accumulators, in particular in the form of medium and high-pressure gas accumulators. Thus, even with only one conveying part with intermittent delivery stroke, it is basically possible to achieve a homogenised conveying volume flow even within the scope of conveying gas.

In some embodiments of the conveying device, it is provided that at least one cooling device is inserted between individual compressor stages. It has been shown that, particularly when using multi-stage compression for conveying and compressing gases, such as hydrogen, the temperature can rise significantly, leading to undesirable expansion of the gas, which in turn would lead to an increase in the drive power needed in this respect for the individual conveying or compressor parts, which can be prevented by the aforementioned intermediate cooling between the compressor stages.

In some embodiments of the conveying device, it is provided that the fluid flow, in particular gas flow, on the discharge side of each compressor part is monitored by means of contamination sensors. If contamination is detected, even if unlikely, the relevant plant section of the conveying device should be shut down immediately so that any parts which are contaminated or have become unusable can be replaced as part of maintenance.

Particularly when conveying or transporting high-purity gases, such as hydrogen, there must be no particulate contamination in the gas flow within the scope of the intended use, for example in fuel cell operation.

Due to its modular design, the compressor solution according to the present teachings not only facilitates adaptation to required compressor mass flows by appropriate scaling of the media-separating devices according to size and number, but also allows easy adaptation of the compression ratios themselves. In addition, in the area of control, the associated hydraulic control circuit with its components is only single and not executed multiple times for a plurality of conveying and compressor parts. Accordingly, a specific use of the conveying device provides for compression of hydrogen gas in stages using individual, identical compressor parts. This thus has no equivalent in prior art.

The discussed conveying device is explained in greater detail in the following with reference to further embodiments according to the drawings. The drawings show principles and are not to scale.

Specific references to components, process steps, and other elements are not intended to be limiting. Further, it is understood that like parts bear the same or similar reference numerals when referring to alternate FIGS.

The conveying part denoted as a whole by 10 in FIG. 1 is connected to an inlet 12 and an outlet 14 in a fluid-conducting manner. In addition, the conveying part 10 comprises a media-separating device 16 in the form of a bellows, in particular in the form of a pleated bellows. The media-separating device 16 in the form of a bellows, for example consisting of metal, separates the liquid of a metering volume on the outside of the bellows from the fluid to be conveyed or compressed inside the bellows in a hermetically sealed manner. Insofar as the conveying part 10 is used to convey gases, such as hydrogen gas, the conveying part 10 likewise acts as the compressor part 10. In one embodiment, the folding bellows itself consists of a very thin metal sheet and is configured to be highly elastic in such a manner that the pressure applied from outside and the pressure prevailing inside the bellows differs by less than 0.1 bar. This means that a pressure applied fluidically from outside, and this can feasibly be a pressure in the order of magnitude of almost 1000 bar, is transferred to the fluid inside the bellows almost without loss.

The stroke volume of the media-separating device 16 or the bellows, respectively, is designed in such a manner that it is greater than the displacement of the metering volume that can be generated by a maximum pump cylinder movement of a drive part 18 (FIG. 2) together with a defined clearance at the end positions, so that no forced overexpansion of the bellows can occur as a result of a differential pressure arising via the bellows. To monitor this condition, a monitoring device, which will be discussed in greater detail, is provided on the drive part 18 as well as two end position monitors 20 for the media-separating device 16 which are arranged opposite each other and can detect any deviations in this respect. Such deviations can occur due to the fact that leaks can arise on the drive part 18 which would produce an increase or decrease in the metering volume on the conveying part 10. This would also inevitably result in shifting of the bellows position which might lead in turn to consequential damage to the bellows should its permissible expansion be exceeded.

The media-separating device 16 shown in FIG. 1 substantially performs two functions:

On the one hand, separation of the two fluids of the system from each other, namely the hydraulic fluid used in the metering volume from the high-purity gas to be conveyed and if necessary compressed, and, on the other hand, the actual conveying and compressor function.

For separating the fluid systems, the media-separating device 16, in the form of the bellows, permits hermetic separation and, for the conveying and compressor function, the bellows possesses highly flexible deformability with a large stroke volume. In addition, during a compression process, very high gas temperatures occur in the gas chamber, i.e., in the inner or receiving chamber 21 of the bellows, depending on the desired compression ratio, which said chamber has to withstand without damage. The requirements to this effect can be met with an appropriately designed metal bellows.

For the conveying and compressor function, the media-separating device 16 is equipped with valves, in the form of two non-return valves 22 acting in opposite directions, as so-called compressor valves. So that the media-separating device 16, in the form of the bellows, can be removed easily and without major gas losses in the event of servicing, it has a switchable directional-control valve 24 on the inlet 12 side in the associated fluid duct which, in the blocked state, according to the diagram shown in FIG. 1, blocks fluid access into the interior of the bellows via the inlet 12. Since the servicing should be carried out as easily and quickly as possible, a defined separating joint 26 is provided for this purpose which, as a standardisable interface, permits a quick change for the respective media-separating device 16. In an embodiment, such a separating point 27 can also extend directly above the bellows. Likewise, a discharge device 28 is installed so that fluids, such as residual gases in the conveying part 10, can be safely discharged before any disassembly of the media-separating device 16. Each of the two non-return valves 22 is associated with an Independent fluid line as inlet 12 and outlet 14, leading to the media-separating device 16. However, there is also the option (not shown) to provide only a single line which leads to the media-separating device 16 and which branches at the opposing end in a T-shape, one branch of the line forming the inlet 12 and the other branch of the line forming the outlet 14. Comparable to the non-return valves 22, one non-return valve in each case is used in an associated branch of the line to ensure the uninterrupted supply and discharge of fluid and prevents an undesirable backflow towards the fluid source during the delivery stroke with the media-separating device 16.

Proper function of the media-separating device 16 is constantly monitored, in particular by the two signal transmitters 20 of the end position monitor which signal that the associated end positions have been reached during the stroke of the metal bellows. If the metal bellows assumes its maximum extended position at maximum chamber volume, it actuates the lower end position monitor 20, viewed in the direction of FIG. 1, and at a maximum delivery stroke and accordingly minimum chamber volume, the upper end position monitor 20 is actuated.

Figure 6:
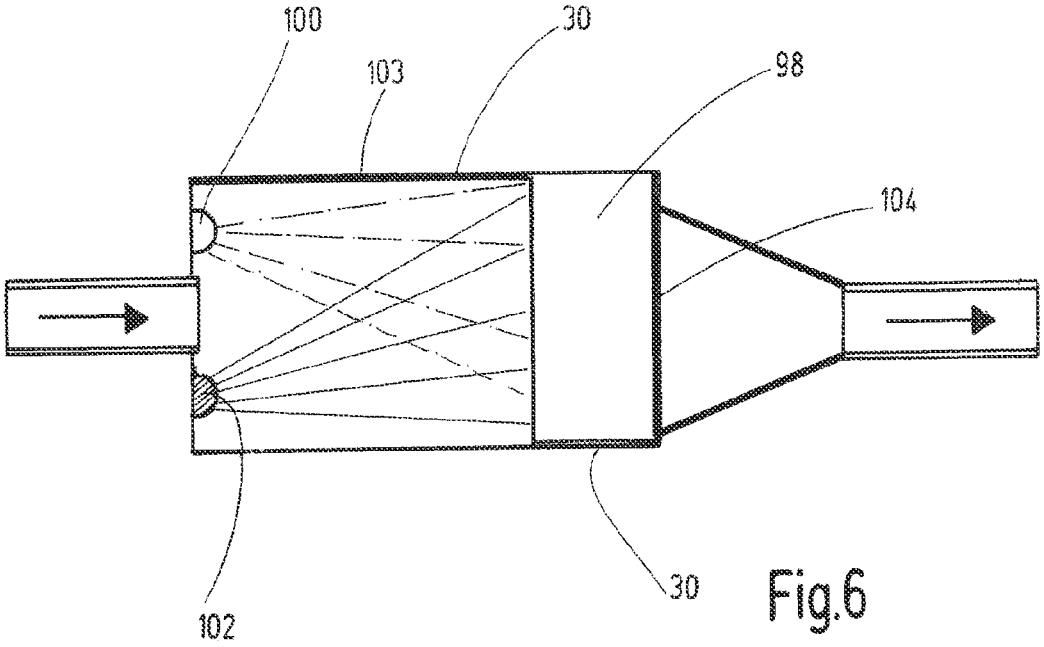
FIGS. 6 and 7 show two different types of contamination sensors.
Figure 7:
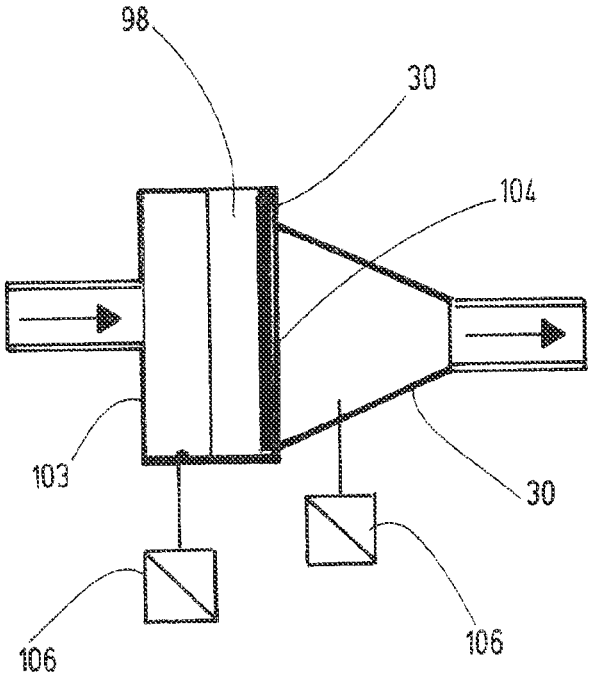

Furthermore, a contamination sensor 30 is located on the outlet side of the conveying part 10, such as shown by way of example in FIGS. 6 and 7, and monitors the leak-tightness of the metal bellows.

The upper end of the bellows is connected to a separating plate 32 which divides a housing 34 of the conveying part 10 into two chambers separated from each other, the contamination sensor 32 being arranged in the upper chamber as well as a pick-up point for the discharge device 28 on the inlet side of the conveying part. The second lower chamber accommodates the bellows which is hermetically sealed on its underside with a bellows plate 36, and between the outside of the bellows and the inside of the relevant housing part an intermediate or fluid chamber 38 is formed which is in communication with the drive part 18 via a fluid-conducting connection 40 and forms the connection for the driving metering volume of the drive part 18 for operating the conveying or compressor part 10.

The possible directions of fluid flow are shown by arrows in FIG. 1. Thus, when the bellows is extended by means of the drive part 18 and the directional-control valve 24 is switched to its fluid-transmissible position, fluid to be conveyed flows into the receiving chamber 21 of the bellows via the inlet 12 and the right-hand compressor valve 22, viewed in the direction of FIG. 1. In this respect, an intake stroke is achieved via the media-separating device 16. Again, by appropriate control of the drive part 18, the bellows plate 36 moves upwards and the bellows volume decreases so that fluid stored in the bellows during the intake stroke passes via the contamination sensor 30 and, when the left-hand compressor valve 22 is inevitably opened, to the outlet 14 of the conveying or compressor part 10. During the corresponding discharge stroke via the outlet 14, the right-hand non-return or compressor valve 22 is closed so that fluid cannot flow back again unintentionally to the inlet 12 during the discharge stroke. The performance of such intake and discharge strokes can be achieved in rapid succession by means of the drive part 18 which will be explained in greater detail below.

Figure 2:
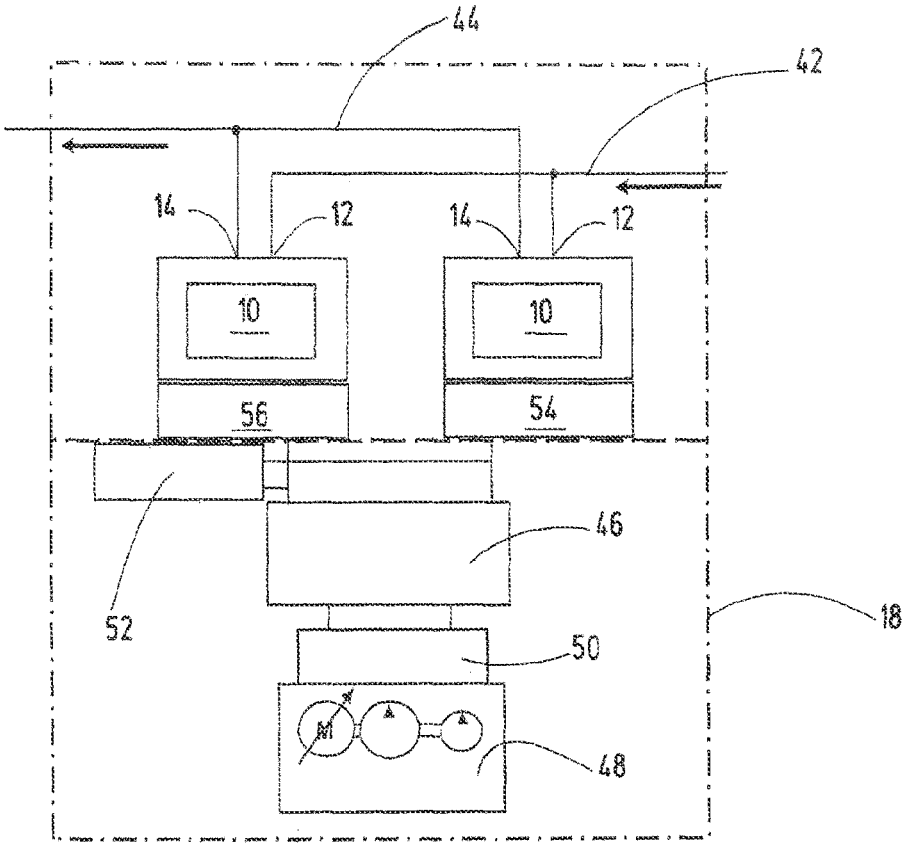
FIG. 2 shows an example conveying device with two conveying parts which are controlled by a common drive part.

Of course, a conveying pause occurs during operation of the conveying or compressor part 10 according to FIG. 1 which is necessarily formed by the intake stroke by means of the bellows via the inlet 12. In this respect, the conveying part 10 or compressor part only permits intermittent conveying operation. In the embodiment according to FIGS. 2 and 3, on the other hand, two conveying parts 10 are connected in parallel which are alternately controlled by a common drive part 18. As shown in FIG. 2, fluid is supplied to both one and the other inlet 12 of a conveying part 10 via a common supply line 42. The outlet 14 of each conveying part 10 is connected in turn to a common discharge line 44. In this way, it is possible to achieve quasi-continuous conveying operation for the medium to be conveyed or transported, in that one conveying part 10 always conveys fluid into the discharge line 44, while the other conveying part 10 removes fluid from the supply line 42 by means of an intake stroke. For example, if gas is supplied at low pressure via the supply line 42, a gas discharge under high pressure is achieved in the discharge line 44 by means of the two conveying or compressor parts 10. In this case, high compression ratios of around 1:10, for example, can be achieved.

Figure 3:
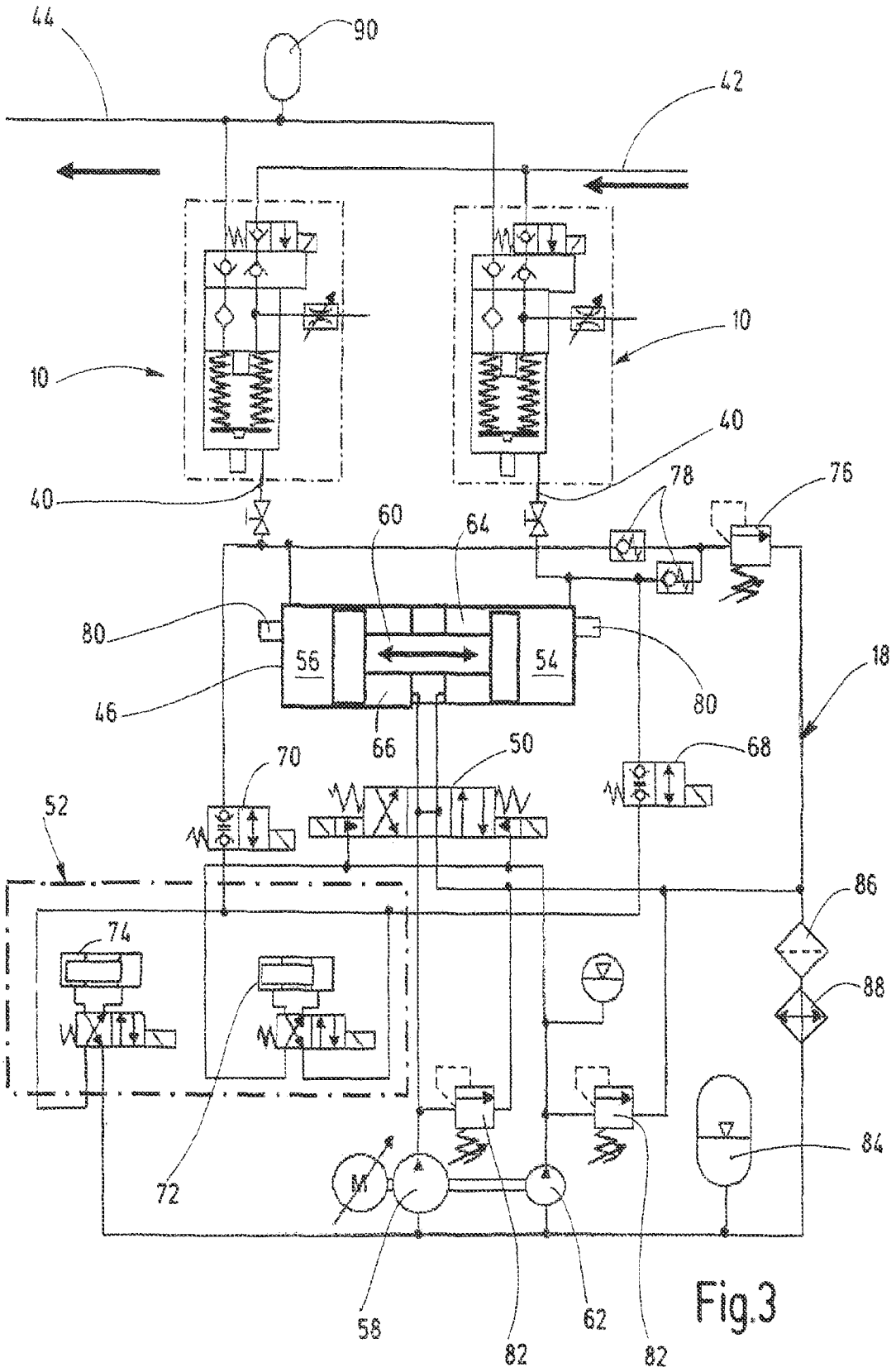
FIG. 3 shows the solution of FIG. 2 in implementation with fluid components.

The drive part 18 has a hydraulic working or pump cylinder 46 which can be controlled by means of a hydraulic drive 48 and a main valve 50. Furthermore, FIG. 4 discloses a metering unit 52 which can save a small correction volume into the connecting lines between the pump cylinder 46 and the metering volumes 54 and 56, respectively, or can withdraw a small correction volume from these connecting lines. FIG. 3 shows the drive part 18 with its individual components in greater detail. In particular, the drive part 18 comprises the hydraulically drivable working or pump cylinder 46 which is driven by the volume flow of a drivable hydraulic pump 58 as the main pump, the piston-rod unit 60 of the cylinder 46 moving back and forth according to the double arrow, depending on the switching position of the main valve 50. The main pump 58 is driven at variable speed by means of a motor M and as a result can be adjusted to the desired conveying and compression output. The cylinder 46 provides the required power for compressing and conveying the fluid or gas by pushing the constant metering volume 54, 56, which is located between cylinder 46 and the respective media-separating device 16 of a conveying part 10, back and forth. In addition to the main pump 58, there is also a control pump 62 which can supply various auxiliary functions with hydraulic energy, namely, as shown in FIG. 3, the metering unit 52 as a whole and the pilot control of the main valve 50 in the form of an electromagnetically actuated 4/3 way valve.

Figure 4:
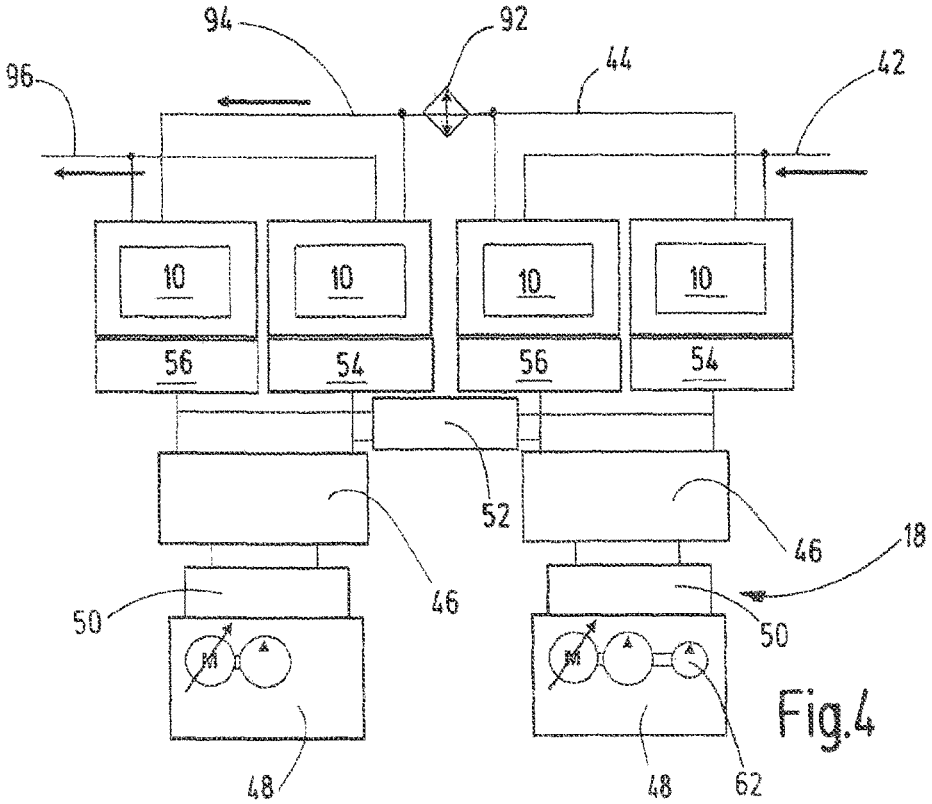
FIG. 4 shows a sequence of two example conveying devices of FIG. 2 forming an overall conveying device.
Figure 5:
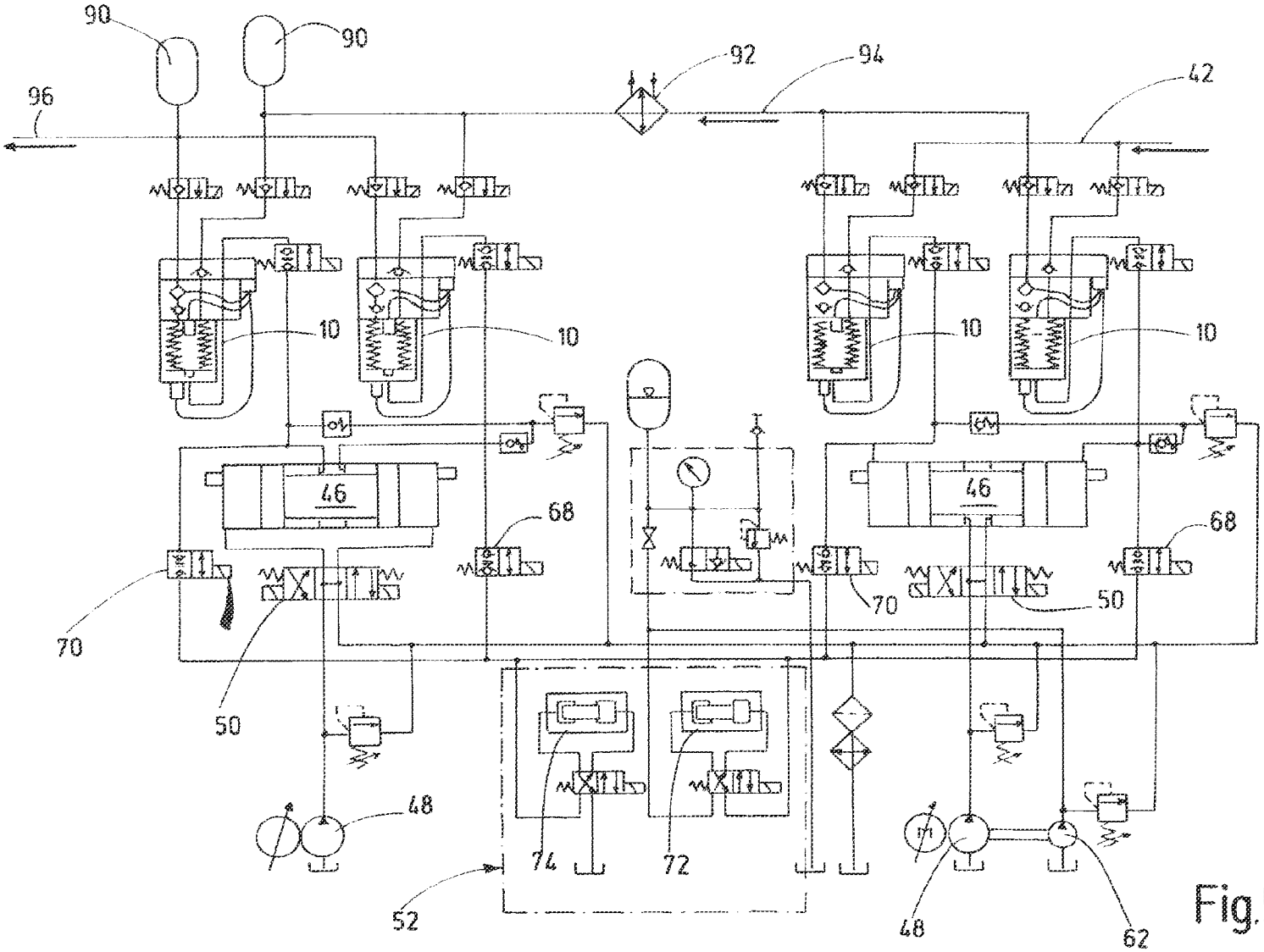
FIG. 5 shows an example conveying device implemented with individual components according to the principle diagram shown in FIG. 4.

In the case of smaller conveying and compressor parts 10, the main valve 50 can also be single-stage because then only smaller volume flows, for example <100 l/min, are required. However, in the case of multi-stage compressors as shown in FIGS. 4 and 5, which then have a main pump 58 for each compressor stage, only one stage is ever equipped with an additional control pump 62 (FIG. 5) which then also supplies the other stages. Alternatively, the drive part 18 could also comprise a piston machine, for example in the form of an in-line piston pump rotationally driven via a crankshaft (not shown).

Between the working or pump cylinder 46 and the respective media-separating device 16, which are connected to each other via the respective connection 40, there is a volume of liquid, which is referred to as the metering volume 54, 56, and which is pushed back and forth between the cylinder 46 and the respective media-separating device 16. This metering volume 54, 56 is almost incompressible with the result that a movement of the cylinder 46 can be transferred to the respective media-separating device 16 without loss or delay. In this case, the respective metering volume 54, 56 is bounded by a piston face of the piston-rod unit 60, the rod side being connected to the outlet of the main valve 50 by fluid lines. In this respect, the rod of the piston-rod unit 60 divides the cylinder 46 into two rod-side fluid chambers 64 and 66.

The metering unit 52, which can add small volumes into the respective metering volume 54, 56 or can withdraw small volumes from said metering volume, is used to compensate for leaks at the working or pump cylinder 46. The metering unit 52 consists in this respect of two small, self-contained reciprocating pistons which, for moving from one end position to the other, can take up a small, defined stroke volume (for example of <10 $cm^3$) and discharge it on the other which is initiated by switching associated directional-control valves 68, 70 for metering in or metering off.

The metering in unit with reciprocating piston and associated directional-control valve is denoted by 72 in FIG. 3 and the corresponding metering off unit by 74. The metering volume 54 or 56, which is to be increased or decreased accordingly, is thus controlled by the associated metering valve 68 or 70. After completion of a required metering process, the respective metering valve 68, 70 can be shut off again. To protect against overloading, the metering volumes 54, 56 are additionally protected by a secondary pressure protection device 76 which consists of a pressure-limiting valve that is connected to both metering valves 54, 56 via non-return valves 78. An end position monitor 80 or a stroke measuring device (not shown) of the piston-rod unit 60, which cooperates with the end position monitor 20 of the media-separating device 16 as part of an overall control system, is used in turn to monitor the cylinder 46.

As FIG. 3 further shows, the feed pump 62, like the main pump 58, is provided with a primary pressure protection device 82, a tank accumulator 84 in the form of a conventional hydraulic accumulator also being connected on the fluid entry side for the main pump 58 and the control pump 62. Furthermore, a filter 86 and a cooler 88 are present on the inlet side for the individual pumps 58, 62. A hydraulic accumulator 90 is connected to the discharge line 44 for homogenisation of the conveying flow.

With the solution shown in FIG. 3, the conveying device consists substantially of the drive part 18 and the conveying or compressor part 10, the fluid on the compressor side, regularly in the form of a gas to be compressed, being separated from the fluid on the drive side, the metering volume, regularly in the form of a hydraulic medium, by the respective media-separating device 16 in the form of the bellows. The modular design for the compressor easily enables scaling up to larger, single-stage compressor units according to the diagram shown in FIGS. 2, 3 and to multi-stage units according to the diagrams shown in FIGS. 4 and 5.

In the multi-stage, in particular two-stage, compressor design according to FIG. 4, the conveying device according to FIG. 2 is fluidically connected twice in series, a cooling device 92, in particular in the form of a heat exchanger device, being incorporated between the two compressor stages. The gas supplied via the feed line 42 is in the low-pressure range and is increased to a medium pressure by means of the first compressor upstream of the intercooler 92 as the cooling device. In this case, the working cylinder 46 of the first compressor stage acts as the pump cylinder or generator for the intermediate pressure mentioned. After passing through the intercooler 92, the gas in turn reaches the intake or inlet side of the second compressor stage with the two conveying or compressor parts 10 via a medium-pressure line 94. Thus, on the outlet side of the second compressor stage, the gas discharge pressure is raised to high pressure in a high-pressure line 96. In this way, the two-stage compressor according to FIG. 4 can be used to raise a low gas pressure of 50 bar, for example, to a medium pressure of around 160 bar and, on the high-pressure side, to a discharge pressure of 500 bar. In this way, with two-stage compression, compression ratios of 1:3.16 can be expected in both compressor stages. If the two-stage compressor solution according to FIG. 4 is extended in terms of 3-stage compression by adding a further single-stage compression according to FIG. 3 with a compression ratio of less than 1:3 per stage, pressures in the range of 1000 bar can be achieved here, particularly for hydrogen. Even starting with very low pressures of 15 bar, it is then possible with 3-stage compression to achieve output pressures of 500 to 600 bar.

The basic configuration of a two-stage compressor according to FIG. 4 is reproduced in component construction in FIG. 5, the explanations given so far for the individual components also applying to the multi-stage compressor according to FIG. 5. This solution differs from the previous solution according to FIG. 3 in that the hydraulic accumulator 90 connected to the medium-pressure line 94 forms a medium-pressure gas accumulator and the accumulator 90, which is connected to the high-pressure line 96 in this respect forms the high-pressure gas accumulator for the entire device. Both medium-pressure and high-pressure gas accumulators are used for homogenisation of the conveying flow. Insofar as electric cables are shown in FIG. 5 for the individual conveying and compressor parts 10, they relate to the sensor pick-up for the end position monitor 20 and an electronic evaluation of the contamination sensor 30.

Embodiments of such a contamination sensor 30 are shown in greater detail in FIGS. 6 and 7. As already explained, leaks at the separation points between metering volumes 54, 56 and the respective gas volume to be conveyed can cause high consequential costs. Accordingly, a contamination sensor 30, which monitors the purity of the gas, is arranged immediately downstream of the metal bellows in the line of the outflowing gas flows on the outlet 14 side.

Such contamination sensors 30 can be constructed according to various principles, at least two functions are to be fulfilled in the present case:

1. detection of contamination right at the beginning when contamination starts to develop,
2. capture of initial contamination by a filter.

On detecting contamination, it should be possible to shut down the associated plant section immediately in order to eliminate the cause of the contamination and to replace contaminated parts, for which it is only necessary to interrupt plant operation for a short time. With the technical solution of a contamination sensor 30 according to FIG. 6, contamination of the clean surface of a filter fleece 98 causes a significant colour change which can be detected by a light sensor system. For this purpose, a light source provided with the reference number 100 emits light beams onto the upper side of the filter fleece 98, which in this respect forms a surface sensitive to contamination, and reflected light beams are detected by a light sensor 102. The light beam guidance is indicated in FIG. 6, as is the flow direction through the contamination sensor 30 which is indicated by arrows. To prevent the filter fleece 98 from being pulled out of the sensor housing 103 on the outlet side as the flow passes through, it is supported on a reinforced base layer 104.

The contamination sensor 30 according to FIG. 7 operates with a similar structure; however, now a differential pressure is measured as the flow passes through the filter fleece 98 by means of two pressure measuring devices 106 upstream and downstream of the filter fleece 98.

A signal is emitted if a corresponding increase in flow resistance is detected in the presence of contamination. The differential pressure measurement using the pressure measuring device 106 is carried out with circuit output and the filter fleece 98 can be an impregnatable filter mat which, when impregnated with oil, produces a higher flow resistance than the clean filter fleece 98 according to FIG. 6.

With both sensor principles, the filter fleece 98 that triggered the signal due to contamination can be replaced so that the respective sensor 30 can continue to be used if necessary.

With higher compression ratios, for example 24, the multi-stage compressors according to the embodiments shown in FIGS. 4 and 5 are generally used because the thermodynamics of compressing require excessive drive powers at higher compression ratios. The gas temperatures then also rise so high that special materials have to be used. A multi-stage compressor with intercooling between the compressor stages can then manage with less drive power which is extremely favourable in terms of energy.

The conveying device is particularly suitable for hydrogen applications; however, it can also be used to transport and convey other fluids, including those that are completely incompressible and therefore not compressed during conveying.

The invention has been described in the preceding using various exemplary embodiments. Other variations to the disclosed embodiments may be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, module or other unit or device may fulfil the functions of several items recited in the claims.

The term "exemplary" used throughout the specification means "serving as an example, instance, or exemplification" and does not mean "preferred" or "having advantages" over other embodiments. The term "in particular" and "particularly" used throughout the specification means "for example" or "for instance".

The mere fact that certain measures are recited in mutually different dependent claims or embodiments does not indicate that a combination of these measures cannot be used to advantage. Any reference signs in the claims should not be construed as limiting the scope.

What is claimed is:

1. A conveying device for fluids, namely gases, with an inlet and an outlet and a conveying part which is connected therebetween and can be actuated by a drive part; wherein the conveying part comprises a fluid-tight media-separating device having a receiving chamber with a variable chamber volume, which conveying part becomes connected in a fluid-conducting manner via the receiving chamber to the inlet or the outlet; wherein the conveying part is configured to receive a gas via the inlet as part of an intake stroke, increasing the chamber volume, and to discharge the received gas via the outlet as part of a discharge stroke, reducing the size of said chamber volume; and wherein the conveying part comprises at least one internal particle contamination sensor disposed between the inlet and the outlet, which at least one internal particle contamination sensor is configured to monitor gas flow on a discharge side of the conveying part for particle contamination.

2. The conveying device of claim 1, wherein the media-separating device is formed of a bellows which is fluidically controlled by the drive part in such a manner that the chamber volume increases during an intake stroke and decreases during a discharge stroke.

3. The conveying device of claim 1, wherein the drive part has a hydraulic working cylinder which can be controlled by a hydraulic drive and a main valve.

4. The conveying device of claim 3, wherein the hydraulic working cylinder with a piston-rod unit uses a metering chamber of predefinable metering volume to predefine the intake and discharge stroke.

5. The conveying device of claim 1, wherein, in order to obtain a homogenised conveying volume flow, a second conveying part is provided which performs a discharge stroke while the conveying part performs an intake stroke and vice versa.

6. The conveying device of claim 1, wherein, for conveying gases, the conveying part acts as a compressor part, wherein the conveying device comprises two conveying parts that form a single-stage compressor.

7. The conveying device of claim 1, wherein at least one metering unit is present which introduces at least one quantity of a metering volume into a respective metering chamber of the working cylinder or discharges the at least one quantity therefrom.

8. The conveying device of claim 1, wherein a metering unit is connected to a metering in and metering off unit by metering valves;

the metering unit is protected by a secondary pressure protection device;

positions of a working cylinder can be detected via a monitoring device;

a homogenisation of a conveying flow takes place using hydraulic accumulators; and/or at least one cooling device is provided.

9. Use of a plurality of the conveying device of claim 1 for compression of gases in stages.

10. The conveying device of claim 2, wherein the drive part has a hydraulic working cylinder which can be controlled by a hydraulic drive and a main valve.

11. The conveying device of claim 2, wherein a hydraulic working cylinder with a piston-rod unit uses a metering chamber of predefinable metering volume to predefine the intake and discharge stroke.

12. The conveying device of claim 3, wherein the hydraulic working cylinder with a piston-rod unit uses a metering chamber of predefinable metering volume to predefine the intake and discharge stroke.

13. The conveying device of claim 1, wherein a hydraulic working cylinder with a piston-rod unit uses a metering chamber of predefinable metering volume to predefine the intake and discharge stroke on a piston or rod side.

14. The conveying device of claim 1, wherein a hydraulic working cylinder with a piston-rod unit uses a metering chamber of predefinable metering volume to predefine the intake and discharge stroke, wherein the working cylinder is actuated via a main valve on a rod or piston side.

15. The conveying device of claim 2, wherein, in order to obtain a homogenised conveying volume flow, a second conveying part is provided which performs a discharge stroke while the conveying part performs an intake stroke and vice versa.

16. The conveying device of claim 3, wherein, in order to obtain a homogenised conveying volume flow, a second conveying part is provided which performs a discharge stroke while the conveying part performs an intake stroke and vice versa.

17. The conveying device of claim 4, wherein, in order to obtain a homogenised conveying volume flow, a second conveying part is provided which performs a discharge stroke while the conveying part performs an intake stroke and vice versa.

18. The conveying device of claim 2, wherein, for conveying gases, the conveying part acts as a compressor part, wherein the conveying device comprises two conveying parts that form a single-stage compressor.

19. The conveying device of claim 3, wherein, for conveying gases, the respective conveying part acts as a compressor part, wherein the conveying device comprises two conveying parts that form a single-stage compressor.

20. The conveying device of claim 1, wherein the at least one particle contamination sensor is arranged between the media-separating device and a separating joint of the conveying device.

21. The conveying device of claim 1, wherein the particle contamination sensor comprises a filter fleece.

* * * * *